United States Patent [19]

Choi et al.

[11] Patent Number: 4,810,466

[45] Date of Patent: Mar. 7, 1989

[54] HEAT RESISTANCE NI—CR—W—AL—TI—TA ALLOY

[75] Inventors: Ju Choi, Seoul; Chong K. Lee, Kyunggi-do, both of Rep. of Korea

[73] Assignee: Korea Advanced Institute of Science and Technology, Seoul, Rep. of Korea

[21] Appl. No.: 111,641

[22] Filed: Oct. 23, 1987

[30] Foreign Application Priority Data

Nov. 28, 1986 [KR] Rep. of Korea ..... 10134/1986

[51] Int. Cl.[4] ..... C22C 19/05

[52] U.S. Cl. ..... 420/448

[58] Field of Search ..... 420/447, 448; 148/410, 148/428

[56] References Cited

FOREIGN PATENT DOCUMENTS 54-33212 10/1979 Japan .
832162 10/1983 Rep. of Korea .
2103243 2/1983 United Kingdom .

*Primary Examiner*—R. Dean
*Attorney, Agent, or Firm*—Birch, Stewart, Kolasch & Birch

[57] ABSTRACT

An Ni—Cr—W—Al—Ti—Ta alloy exhibiting an improved high creep rupture strength and a corrosion resistance contains by weight, 12 to 20% of Cr, 18 to 25% of W, 1 to 3% of Al, 0.2 to 1.5% of Ti, 0.2 to 1.5% of Ta, 0.02 to 0.3% of C, less than 0.1% of B, less than 0.2% of Zr and the balance being substantially Ni.

1 Claim, 1 Drawing Sheet

HEAT RESISTANCE NI—CR—W—AL—TI—TA ALLOY

BACKGROUND OF THE INVENTION

The present invention relates to an Ni—Cr—W—Al—Ti—Ta alloy exhibiting an excellent heat resistance, a high creep rupture strength and an exceptional good corrosion resistance with good forgeability. Therefore, the alloy of the present invention can be utilized as a material for parts of power generators or various types of equipment exposed to chemicals which are required to be operated at a high temperature, e.g. over 1000° C., under a highly corrosive atmosphere.

In order to improve heat efficiency, there is a tendency when operating many types of equipment to use a temperature that is increased, to say, over 1000° C. To meet the afore-mentioned conditions, an alloy which exhibits excellent high temperature characteristics is desired.

Here-to-fore, concerning conventional heat-resistant alloys, a series of cast precipitation hardened nickel-base superalloys have been considered to be suitable with regard to high temperature strength properties. However, these alloys are poor with regard to forgeability properties in combination with formability properties. Many other inventors alloys have been developed which exhibit a good workability without the deterioration of other mechanical properties. For example, such alloys that have been disclosed include 23%Cr-18%W-Ni alloy disclosed in Japanese patent publication No. 54-33,212 and Ni—Cr—W alloy disclosed in United Kingdom patent No. GB 2103243A. According to the above-mentioned references, the alloys are composed of by weight less than 0.1% of C, 21 to 26% of Cr, 16 to 21% of W, less than 1% of Ti, less than 1% of Nb, less than 0.1% of B, less than 0.5% of Zr, less than 1.0% of Hf, less than 1.5% of Al, less than 6% of Co, less than 3% of Mo, less than 6% of Fe, and the remainer of the composition being Ni. The present invention relates to an alloy exhibiting a high workability as a well as high temperature strength at above 1000° C. The alloy which is disclosed in Korean Pat. No. 16420/ has a composition of 16.5% Cr-21.5%W-1.5%Al-0.9%Ti-BalNi.

SUMMARY OF THE INVENTION

It is an object of the present invention to provide an improved alloy based on the Ni—Cr—W—Al—Ti, alloy of Korean Pat. No. 16420. The present invention is accomplished by the addition of Ta and the adjustment of C content in the alloy. The creep rupture strength of the alloy of the present invention is increased 1.4 times when compared with the alloys of Korean Pat. No. 16420 under the condition of 4 Kg/mm$^2$ of stress at 1000° C., when less than 1.5% of Ta is added and 0.02 to 0.3% of C by weight is adjusted on the basis of Korean Pat. No. 16420. It is also found that the alloy of the present invention exhibits a good workability and, hence, can easily be formed into the shape of rods, plates etc. As shown in Table 3, the present alloy exhibits an excellent corrosion resistance under the environments of strong acids such as hydrochloric acid, nitric, acid, sulfuric acid and/or bromotrifluoromethane as well as an oxidation resistance.

DETAILED DESCRIPTION OF THE PREFERRED EMBODIMENT

Figure 1:
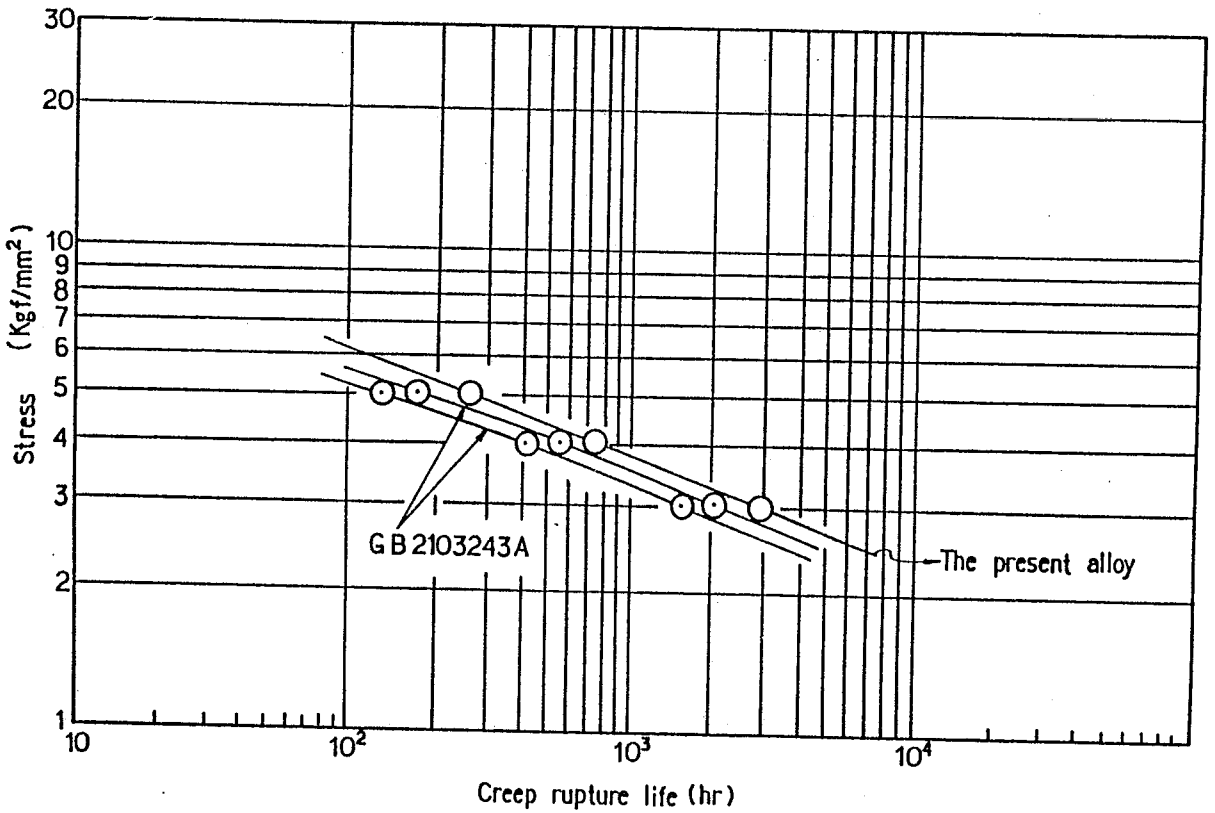
FIG. 1 shows the result of creep rupture test of the alloy of the present invention when compared with a conventional alloy.

The content range of alloying elements in the alloy, is essentially from 12 to 20% of Cr, 18 to 25% of W, 0.2 to 1.5% Ti, 1 to 3% of Al, less than 0.1% of B, less than 0.3% of C, less than 0.2% of Zr and less than 1.5% of Ta with the balance of Ni.

The reason of the defined range of the addition of each element in the present invention is as follows: Cr and W elements are added to the Ni base matrix to achieve a solid solution for promoting the strength thereof. In 2 range of W-content as defined above, the Cr content exceeding 20% undesirably degrades the strength of the alloy. The proper amount of Al and of Ti is added in order to form gamma prime precipitates which give rise to the precipitation hardening. Furthermore, the addition of Ta elevates the creep rupture strength remarkably at 1000° C. by the solid solution of Ta into both matrix and gamma prime precipitates. In the alloy, the precipitate $\alpha$-W is also found to be in the matrix by the reduction of the solubility of W and this provides a beneficial effect with regard to the strengthening. The C plays an important role by forming stable $M_6C$ type carbide at the grain boundary. An optimum amount of carbides contributes to the strengthening. However, excessive carbides bring out the deterioration of forgeability. The purpose of the addition of B and Zr is to strengthen the grain boundary and to stabilize the carbides. When the amount of Zr and B is excessive, it results in a grain boundary segregation which brings out poor workability.

The present invention will be fully understood from the following description of example.

EXAMPLE

The purity of raw materials used for the alloy were chosen as high as 99.9%. W was used as a metal powder, B was added with the mother alloy Ni-15% and C with graphite. A vacuum induction for melting was carried out to obtain 5 kg ingot under a pressure of $10^{-3}$ Torr. At first, Ni, W and graphite were charged and melted, following up the addition of Cr. Subsequently, Al, Ti, Zr and B were added to the melt. The melt was poured into the cast iron mold. The ingot was forged at a temperature of 1250° C. and finished at about 900° C. The forged rod of 20 mm diameter was solution treated at 1300° C. for 1 hr. The specimens were prepared from heat treated rod and then creep rupture test was carried out at 1000° C. under the stress of 5, 4 and 3 kg/mm$^2$, respectively. Table 1 shows the chemical composition of the alloy of the present invention compared with conventional alloys. Table 2 shows the result of creep rupture test of the alloy of the present invention in comparison with conventional alloys. Table 3 illustrates the result of corrosion resistance test of the alloy of the present invention.

TABLE 1

Chemical composition of the alloy of the present invention compared with conventional alloys

| Alloy | Composition (%) | | | | | | | | | | | |
|---|---|---|---|---|---|---|---|---|---|---|---|---|
| | Cr | W | Ti | Al | C | B | Zr | Ta | Ni | Co | Mo | Fe |
| The present alloy | 14.7 | 20.0 | 0.54 | 1.94 | 0.034 | 0.001 | 0.08 | 0.51 | Bal | — | — | — |
| The alloy concerning Korean Pat. No. 16420 | 16.5 | 21.5 | 0.9 | 1.5 | 0.05 | 0.005 | 0.06 | — | Bal | — | — | — |
| Inconel 617 | 22.0 | — | — | 1.0 | 0.07 | — | — | — | Bal | 12.5 | 9.0 | — |
| GB 2103243A | 23.6 | 18.1 | 0.53 | — | 0.057 | — | 0.02 | — | Bal | — | — | — |
| Hastelloy X | 22 | 0.5 | 0.01 | 0.02 | 0.06 | — | — | — | Bal | 0.5 | 9 | |

TABLE 2

The Result of Creep Rupture Test (Temperature: 1000° C., stress: 4 Kg/mm$^2$)

| Alloy | Creep Rupture Life (hr) | Elongation (%) |
|---|---|---|
| The present alloy | 764 | 11 |
| The Alloy Concerning Korean Pat. No. 16426 | 554 | 10 |
| Inconel 617 | 100 | — |
| GB 2103243 A | 600 | — |

TABLE 3

Comparison of corrosion resistance of the alloy of the present invention compared with conventional alloys

| Alloy | Oxidation(1) | 10% HCl solution(2) | Conc. $H_2SO_4$ solution(2) | Conc. $HNO_3$ solution(2) | $CF_3Br$ gas(3) |
|---|---|---|---|---|---|
| The present alloy | Excellent | Good | Average | Excellent | Excellent |
| Hastelloy X | " | " | Excellent | Poor | — |
| Inconel 617 | Good | Average | Poor | " | — |

(1)Oxidation condition: 100 hours at 1000° C. in the air.
(2)Dipping condition: 24 hours at 75° C. in HCl solution, 340° C. in $H_2SO_4$ solution and 110° C. in $HNO_3$ solution.
(3)Dipping condition: Exposured at saturated $CF_3Br$ gas for 90 days at 25° C.

What is claimed is:

1. An Ni—Cr—W—Al—Ti—Ta alloy consisting essentially of: by weight, 12 to 20% of Cr, 18 to 25% of W, 0.2 to 1.5% of Ti, 1 to 3% of Al, 0.02 to 0.3% of C, less than 0.1% of B, less than 0.2% of Zr, 0.2 to 1.5% of Ta, and the balance being substantially Ni.

* * * * *